United States Patent [19]

Sibley

[11] 3,951,364

[45] Apr. 20, 1976

[54] TRACK CIRCUIT

[75] Inventor: Henry C. Sibley, Adams Basin, N.Y.

[73] Assignee: General Signal Corporation, Rochester, N.Y.

[22] Filed: Jan. 9, 1975

[21] Appl. No.: 539,664

[52] U.S. Cl. ..... 246/34 CT; 246/40

[51] Int. Cl.[2] ..... B61L 21/06

[58] Field of Search ..... 246/34 CT, 34 R, 37, 246/40, 28 R, 26

[56] References Cited

UNITED STATES PATENTS

| | | | |
|---|---|---|---|
| 3,450,874 | 6/1969 | Whitten | 246/34 CT |
| 3,663,809 | 5/1972 | Sibley | 246/40 |
| 3,683,176 | 8/1972 | Crofts | 246/34 CT |
| R27,472 | 9/1972 | Thorne-Booth | 246/34 CT |

FOREIGN PATENTS OR APPLICATIONS

| | | | |
|---|---|---|---|
| 1,036,142 | 4/1953 | France | 246/34 CT |
| 1,605,405 | 3/1971 | Germany | 246/40 |

*Primary Examiner*—Trygve M. Blix
*Assistant Examiner*—Reinhard J. Eisenzopf
*Attorney, Agent, or Firm*—Milton E. Kleinman; George W. Killian

[57] ABSTRACT

There is described a track circuit for use with a track section which may or may not include a switch. The system detects the presence of a railroad vehicle within the track section as it constitutes a shunt across the track. The track section is divided into a plurality of segments with each segment having a common boundary with at least one other segment. Alternating current signals are induced into each track segment and a sensor is provided for sensing and responding to the induced a.c. signals. A modulator is provided for intermittently affecting the sensed signal and a detector is provided for detecting and responding to the changing signal.

The detected signals are gated through a logic circuit which provides first and second outputs indicating: the changes are as might be anticipated as a result of the modulation introduced; or, the changes are other than might be anticipated as a result of the modulation, respectively. The shunting effect of a railroad vehicle in any segment will cause the production of the second type of output signal and, therefore, the second type of output signal is an indication of a railroad vehicle within the track section.

27 Claims, 2 Drawing Figures

TRACK CIRCUIT

CROSS-REFERENCE TO RELATED APPLICATION

An AND gate which is suitable for use in circuits for implementing the invention is fully disclosed in the Henry C. Sibley application entitled "Solid-State Fail-Safe Logic System", filed May 30, 1974, given Ser. No. 474,638 and assigned to the same assignee as this application.

BACKGROUND OF THE INVENTION

This invention relates to track circuits, and in particular, to continuous rail track circuits having termination shunts at each end.

In order to promote the general welfare and reduce the possibility of injury to life and property, it is conventional to provide a variety of signals, alarms and safeguards at intersections of highways and railroads. These alarms, signals and safeguards are very common and there are probably few, if any, automobile drivers who have not seen these devices at railroad intersections.

In order to provide an automatic alarm signal, it is necessary to detect the presence of a railroad vehicle. For many decades, circuits called track circuits have been used for such detecting purposes and a wide variety of track circuits have been developed. Some track circuits depend upon sections of track which are electrically isolated from adjacent sections. Track circuits detect the presence of a railroad vehicle by detecting that there is an electrical shunt from one rail to the other. Corrosion on the rail, atmospheric conditions, the quality of rail joints, leakage currents between the tracks, as well as a multitude of other factors, with which those experienced in the art are familiar, influence the sensitivity of the track circuit to the detection of a railroad vehicle.

In prior art systems, insulated joints have been used to define the end of a track section and such techniques have generally provided the most satisfactory track circuits for use in connection with highway intersections and for use in connection with railroad switching. However, installing and maintaining satisfactory insulated joints introduces a host of other problems which are familiar to those in the industry.

SUMMARY OF THE INVENTION

The track section within it is desirable to detect a railroad vehicle, and which is crossed by a highway, may vary from approximately one railroad car length up to several hundred feet. In accordance with the provisions of the track circuit of the present invention, the limits of the track section are defined by shorting bonds at each end. That is, at each end of the track section the two rails are electrically coupled by means of a relatively low resistance bond. At each end of the track section, a means is provided for inducing an alternating current signal of the same frequency, typically approximately 5 kilohertz. The signal may be coupled to the rails by induction means.

The current that is induced in the rail is sensed at each end by sensing coils placed in appropriate proximity to the rails. In one embodiment of the invention, a test shunt is transformer coupled at approximately the center of the rail section. The rail current is modulated by turning the test shunt on and off by a convenient means such as in response to the output of a square wave generator. The current detectors at each end of the track section alternately provide high and low output signals at the modulation rate. The output signals of the current detectors are gated through a series of AND gates. If a train enters the track section, one or both outputs will remain high. This change in outputs of the signal detector will result in a changed output from the logic circuit and an appropriate signal will be provided for actuating alarms or other devices indicating the presence of a train within the track section. If any part of the track circuit should fail to operate, or becomes defective or disconnected, one or both of the current detectors will remain low and thereby provide an alarm signal.

In addition to using the disclosed track circuit in connection with highway crossings, it may be used for highly accurate means for spotting cars at a loading or unloading location.

In the embodiments illustrated, a saturable transformer having a core with a square magnetization loop is used as a relay driver. This transformer is a fail-safe combiner of alternating current signals because successive signals of one polarity can have no effect unless signals of the other polarity intervene.

If circumstances require the transmission of a track signal from one side of the track section to the other side of the track section, it is possible to replace the shorting bonds with series tuned circuits.

In accordance with the foregoing, it is an object of the present invention to provide new and improved arrangements for a track circuit.

It is a more specific object of the invention to provide a track circuit for functioning with a limited length of track section which is defined by shorting bonds at each end.

It is another object of the invention to identify the entrance of a train into and/or its exit from a switch section.

It is another object of the present invention to provide a circuit capable of accurately detecting a railroad vehicle near the outer limits of the track section.

It is another object of the invention to induce signals into a railroad track section and to sense the current induced in the railroad track section and detect if the sensed current differs from that which is anticipated.

It is another object of the invention to induce a signal into the railroad track section and provide a means for modulating the signal and detecting if a sensed signal is other than that which may be anticipated from the inputs and the modulation.

For a better understanding of the present invention, together with other and further objects thereof, reference should be had to the following description taken in connection with the accompanying drawing.

DESCRIPTION OF THE PREFERRED EMBODIMENT

Figure 1:
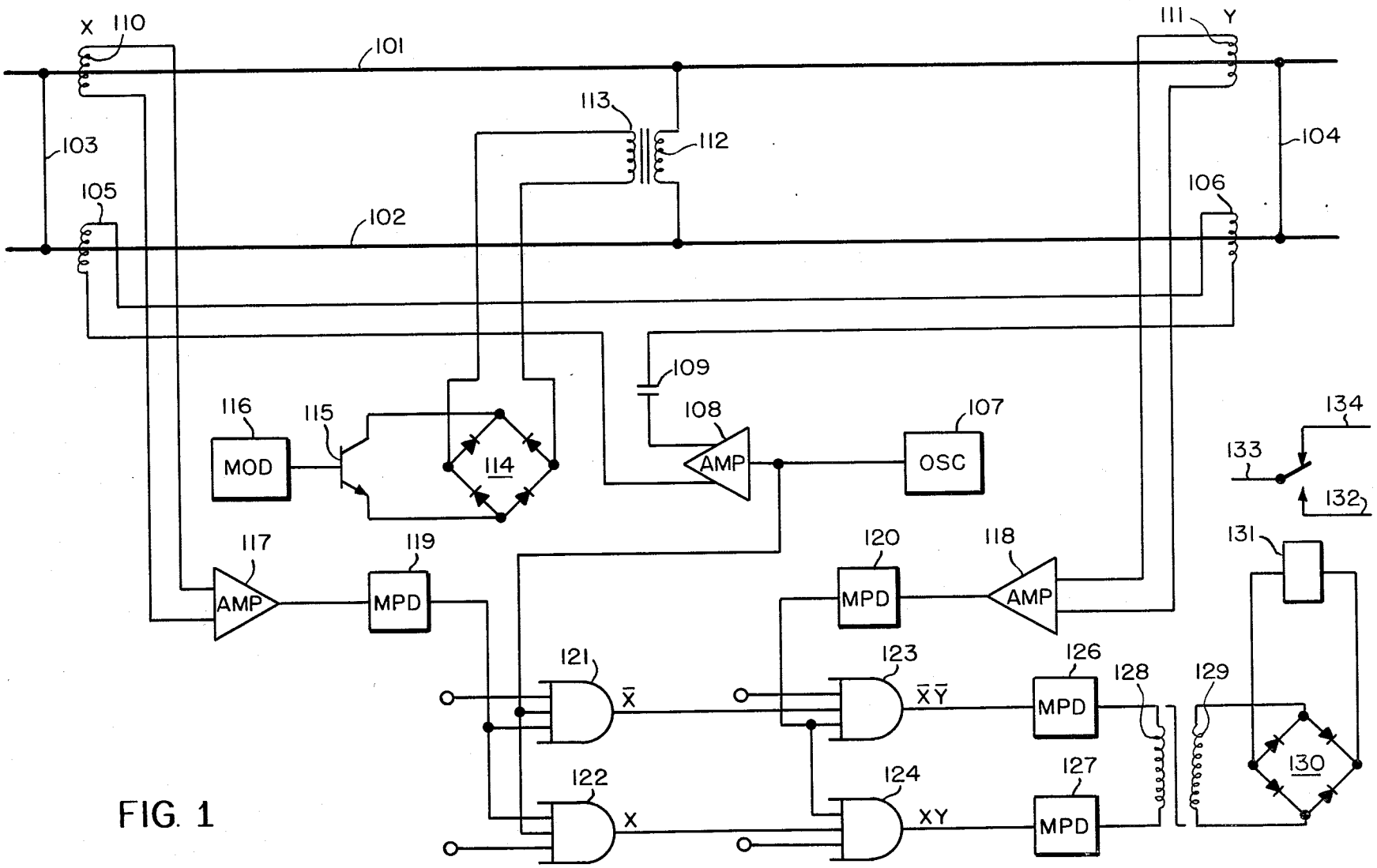
FIG. 1 is a schematic diagram showing the circuit details of the track circuit used in connection with a highway intersection.

The present invention may be used at a highway crossing and employs shorting bonds at each end of the track section or block. An alternating current signal is induced into each end of the block by means of conventional techniques. Rail current is sensed at each end of the block by sensing coils. The currents induced into the track by the two induction coils are such that they oppose each other and are of essentially the same magnitude. Accordingly, if there is no outside influence, the current sensors at each end will sense little, if any, track current.

At approximately the mid-point of the block, a test shunt is transformer coupled to the rails. The test shunt is turned off and on by a modulator. Each time there is an effective shunt across the rails of the block, each sensing coil will sense only the current induced in the rail by the coil at its own end. That is, the net current in the sensing coil will be a positive value instead of near zero. Accordingly, when the test shunt is introduced across the rails of the block, both sensing coils will read a high current. When the test shunt is open, the sensing coils will both read low current. Accordingly, the output signal of the sensing coils will shift from high current to low current at the modulation rate. That is, at the rate that the test shunt is turned on and off by the modulator.

If either sensing coil should go open, it will indicate a constant low current.

If a train should enter the block, there will be a direct shunt across the rails, and the output of the sensing coil, at the end of the block where the train entered, will register a continuous high output. The other current sensor will continue to shift between a high and low signal, but the magnitude of the difference between the high and low signals may tend to be reduced. As the railroad vehicle moves towards the center of the block, the magnitude of the difference in the high and low current output of the remote sensor will tend to be reduced and the magnitude of the difference of the output currents of the sensor at the entering end will tend to increase. When the railroad vehicle is extremely close to one end, the magnitude of the difference in the high and low output signals of the remote sensor may not differ materially from the magnitude of the difference before the train entered the remote end. An appropriate train-in-the-block signal will still be generated.

The output signals of the two sensors are gated through suitable logic circuits, and provided the outputs vary between a high and low signal, a current will be passed through the primary of a square wave transformer in first one direction and then in another. A square wave transformer is one having a square magnitization loop. That is, successive pulses applied to the primary, in the same direction, will not induce a current in the secondary of the transformer, except in response to the first pulse. That is, for current to be induced from the primary to the secondary of this transformer, it is necessary that the current in the primary windings alternate from one direction to the other. Accordingly, the gate circuit is arranged to pass a current in one direction through the primary of the transformer when both sensing coils indicate a low current, and to pass a current in the other direction through the primary of the transformer when both sensing coils indicate a high current. Under these conditions, a current will be transferred to the secondary of the transformer and a relay will be maintained operated. As long as the relay is maintained operated, it provides a signal that the block is unoccupied.

It will be evident that failure of any component will result in release of the relay and a signal indicative of the block being occupied by a railroad vehicle. While such failure does represent a false signal, it is a signal which errs on the side of safety.

As already indicated, when the train enters the block, one or both of the sensors will indicate a continuous high current. This condition prevents the transfer of a signal through the transformer and the maintenance of the relay in its operated condition. Accordingly, the relay will release and provide a signal that there is a train within the block.

It should be observed that the test shunt effectively divided the block into adjacent segments and that both segments included the test shunt as a common element.

Figure 2:
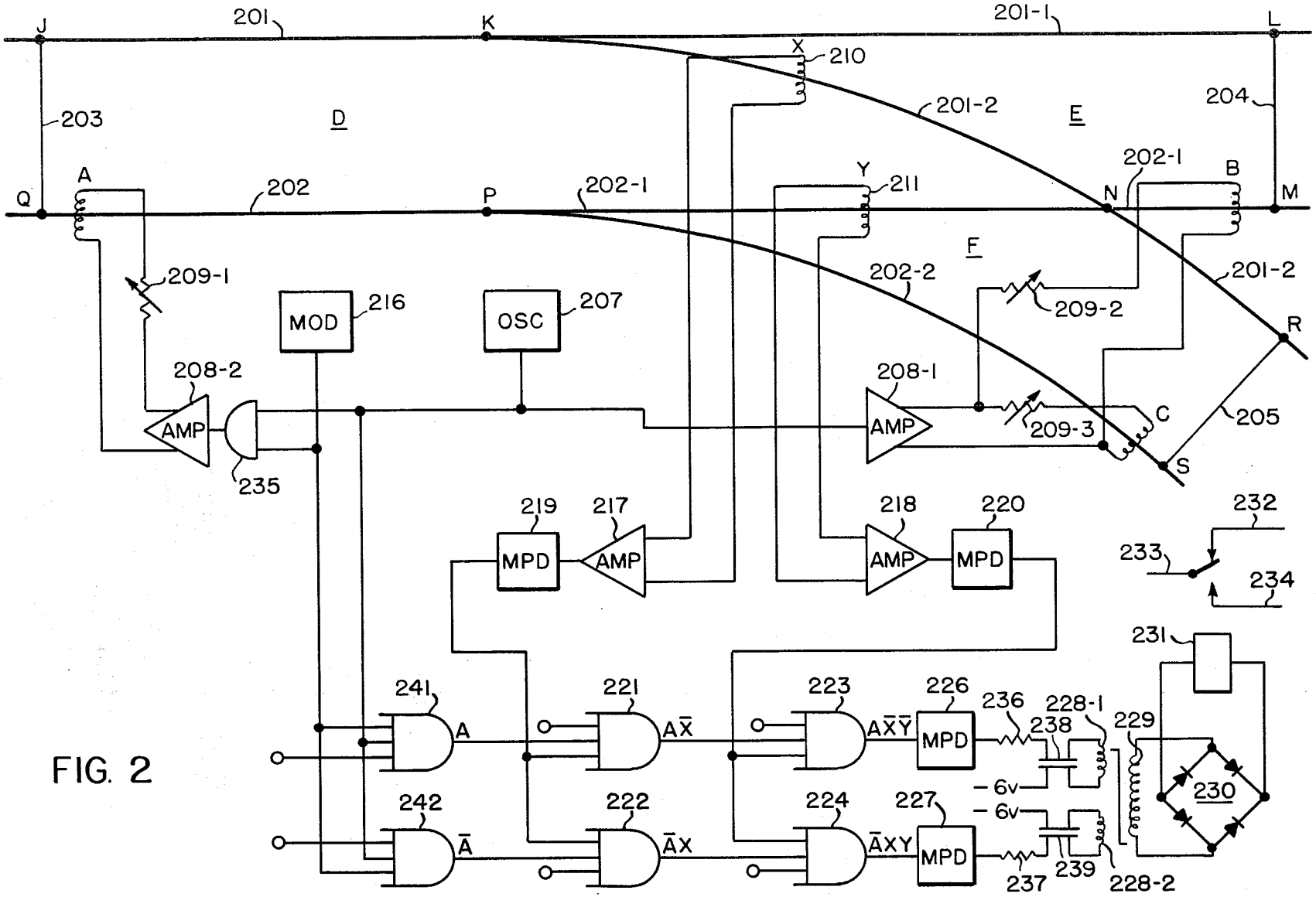
FIG. 2 is a schematic circuit diagram showing the circuit details of the track circuit when there is a switch within the limits of the track circuit.

Another embodiment of the invention which provides for indicating the presence of a train within the area of an approach to, or the exit from, a switch is shown in FIG. 2.

The boundaries of the switch detector track circuit are defined by shorting bonds between the two rails of the track at the entrance to, and the exit from, the switch. In addition, electrical bonds are made between the main track and the side track. This divides the system into three separate segments with each segment sharing at least one leg in common with another segment. One segment shares a first leg in common with the second segment and a second leg in common with the third segment. Induction devices are provided for introducing a signal into each of the segments and the system is so arranged that the currents in the common legs are in opposition. Test coils are placed in proximity to the common legs for sensing the currents therein. As stated, the currents are in opposition and, furthermore, they are adjusted for substantially equal magnitude and, therefore, the sensed current will normally be zero if there is no disturbing influence. The current induced in the segment, which includes the first and second legs, is modulated at a predetermined rate and, therefore, the sensed current will vary between a high and low signal with the change occurring at the modulation rate. The presence of a train within any segment of the switch will alter the currents in the common legs and, thereby, cause at least one of the sensed currents to vary in a manner other than normal.

The sensed currents are gated together with other appropriate signals in such a manner that when there is no train within any of the segments, a relay will be maintained operated. However, the presence of a train in any segment will alter the output of the gate and cause the relay to release, thereby, providing a signal indicative of the presence of a train.

The AND gates illustrated in this application may comprise any of a wide variety of suitable gates. One suitable gate is disclosed in an application of Henry C. Sibley entitled "Solid-State Fail-Safe Logic System", filed on May 30, 1974 and given Ser. No. 474,638 and assigned to the same assignee as the present invention. The AND gate of the cited application, for the purposes of considering its use in the present application, may be considered to comprise an AND gate which will pass an a.c. signal when there is an appropriate d.c. signal and bias. For the purposes of the present application, the input a.c. signal is the center one of the three inputs and the d.c. input is either the top or bottom with a bias coupled to the remaining of the three input leads. Thus, for example, a positive d.c. input may be coupled to the top input terminal and a bias or reference potential coupled to the bottom input terminal. Conversely, a negative d.c. input potential may be coupled to the bottom input lead and the AND gate while the top input lead is connected to the bias or reference. The reference potential may be 0 volts or chasis potential.

Considering now more specifically FIG. 1, there will be seen a pair of rails 101 and 102 with shorting bonds 103 and 104 between the rails 101 and 102. That is, the shorting bonds 103 and 104 provide a direct electrical connection between the rails 101 and 102. The rails 101 and 102 are electrically continuous between the shorting bonds 103 and 104. The distance between the shorting bonds 103 and 104 may vary to suit the requirements of the particular application. Normally, the distance will vary from approximately the length of one railroad car to not over a few hundred feet. A typical application would be at a highway intersection with one of the shorting bonds located on each side of the highway.

Coupled to the rail 102, near each of the shorting bonds 103 and 104, are induction coils 105 and 106, respectively. The induction coils 105 and 106 are placed in an appropriate position so that signals in the induction coils 105 and 106 will be induced into the track 102. Techniques for positioning such coils without interfering with traffic on the track are established and well known and will not be dealt with herein. An oscillator 107 powered from a source (not shown) provides an output which is applied to an amplifier 108. The output of the amplifier 108 is connected to the two induction coils 105 and 106 in series with each other and capacitor 109. The output frequency of the oscillator 107 may be approximately 5 kilohertz. The capacitor 109 is chosen to minimize the effect of the inductance of the induction coils 105 and 106 in the series circuit connecting them to the output of the amplifier 108. So far as presently considered, the induction coils 105 and 106 will tend to induce a current in the loop comprising rail 102, shorting bond 103, rail 101, shorting bond 104 and back to the rail 102. The connections are such that the loop currents induced by the induction coils 105 and 106 are in opposition. Furthermore, the components are so selected and/or adjustments made so that the currents cancel, or nearly cancel, each other.

Within the boundaries defined by the shorting bonds 103 and 104 and coupled near the ends of the rail 101, are sensing coils 110 and 111 and designated X and Y, respectively, The sensing coils 110 and 111, hereinafter more commonly referred to as sensing coil X and sensing coil Y, respectively, are positioned so that they will not interfere with rail traffic but so that they will sense any current flowing in rail 101. With the conditions as thus far described, the sensing coils X and Y will sense substantially zero current. That is, since the currents induced by induction coils 105 and 106 flow in opposite directions and are of substantially the same magnitude, the resultant current is zero and the sensing coils X and Y will not detect any resultant current flow.

At approximately the mid-point between the shorting bonds 103 and 104, there is a test shunt between the rails 101 and 102. The test shunt comprises a transformer having one winding 112 coupled between the rails 101 and 102. With the transformer winding 112 bridged across the rails 101 and 102, it will be evident that the track section between the shorting bonds 103 and 104 is divided into two segments with the transformer winding 112 being a common leg in both segments. Considering now the current induced into the left segment comprising the shorting bond 103, the transformer winding 112 and the section of the rails 101 and 102 between the bond 103 and the transformer winding 112, it will be seen that this current is confined to the left segment and is not sensed by sensing coil Y. In a similar manner, the induction coil 106 induces a current in the right hand segment and its current is not sensed by the sensing coil X. Accordingly, as now described, the sensing coil X and Y will sense the current in their respective segments. As previously described, the currents induced from the induction coils 105 and 106 are in opposition. This means that they are not in opposition as they pass through transformer winding 112.

The other winding 113 of the transformer is coupled across a bridge rectifier 114 and across the other corners of the bridge 114 is coupled the emitter and collector circuit of a transistor 115. The transistor 115 is turned on and off at a rate determined by modulator 116. The modulator rate may be of the order of 100 hertz. Each time the transistor 115 is turned on, the transformer winding 113 is effectively short circuited, and each time the transistor 115 is turned off by the modulator 116, the transformer winding 113 is effectively open circuited. While the transformer winding 113 is effectively short circuited, this short circuit condition is reflected in transformer winding 112 and the current in each segment increases and passes through transformer winding 112. Accordingly, while the transformer winding 113 is short circuited, the sensing coils X and Y will detect relatively large currents. Conversely, while the transformer winding 113 is open circuited, relatively little current will flow in the left and right hand segments and the sensing coils X and Y will detect very little current. Accordingly, the current sensed by sensing coils X and Y will rise and fall at the modulation rate controlled by modulator 116. The reactance of transformer winding 112 limits the flow of current therethrough when the winding 113 is open circuited.

If a train should enter the track section between shorting bonds 103 and 104, the wheels and axle of the train will provide a short circuit between the rails 101 and 102. For the purposes of this description, it will be assumed that a train has entered the section, or block, between shorting bonds 103 and 104 from the left hand side.

The short circuit between the rails 101 and 102 will cause the current induced into the rail 102 from induction coil 105 to be at a maximum, or near maximum, value. Accordingly, the sensing coil X will sense a maximum current. In a similar manner, if a train should enter a block from the right, the sensing coil Y will sense a maximum current.

In summary, when there is no train within the limits of the block, defined by the shorting bonds 103 and 104, the sensing coils X and Y will sense high and low current alternating at the rate determined by the modulator 116. When there is a train within the block, one or both of the sensing coils will remain at a high sensed current. In the event there should be an open circuit or a faulty component, one or both of the sensing coils will indicate a low output.

The output of the sensing coils X and Y are applied to amplifiers 117 and 118, respectively. The output of the amplifiers 117 and 118 are applied to the missing pulse detectors 119 and 120, respectively. These missing pulse detectors 119 and 120 may, for example, comprise components manufactured by the Motorola Company and designated MC1555 or MC1455. When used as a missing pulse detector, the circuit will produce an output when an input pulse fails to occur within the delay of an internal timer. This is accomplished by setting the time delay to be slightly longer than the time between successive input pulses. The timing cycle is then continuously reset by the input pulse train until a change in frequency or a missing pulse allows completion of the timing cycle causing a change in the output level. When the input signal is present, the output signal will be approximately +6 volts. When there is a missing input pulse, or there is no input signal present, the output signal will be approximately −6 volts. The low output signal of the sensing coils X and Y will be interpreted by the missing pulse detectors 119 and 120 as no input; and, therefore, the output of the missing pulse detectors will be approximately +6 volts when their respective sensing coils sense a high current and the output of the missing pulse detectors 119 and 120 will be approximately −6 volts when their respective sensing coils sense a low current.

The output of the oscillator 107 is also applied as an input to AND gates 121 and 122. In addition, the output of the missing pulse detector 119 is applied as an input to the AND gate 121 and 122. The AND gate 121 is connected and designed to pass a signal when there is an input from the oscillator 107 coincident with a negative signal from the missing pulse detector 119. That is, the AND gate 121 will not pass a signal unless the X sensing coil is at a low potential. For this reason the AND gate 121 is designated the $\overline{X}$ gate. That is, the $\overline{X}$ gate 121 passes a signal when there is not a high output signal from the sensing coil X. Conversely, the AND gate 122 is designated the X gate because it passes a signal when there is a high output signal from the X sensing coil. In a similar manner, the output of the missing pulse detector 120 is coupled to the AND gates 123 and 124. In addition, the output of the $\overline{X}$ gate 121 is applied as an input to the AND gate 123; and the output of the X gate is applied as an input to the AND gate 124. The connection of the output of the missing pulse detector 120 to the AND gates 123 and 124 is such that an output pulse will be passed through AND gate 123 when there is a negative potential at the output of missing pulse detector 120 and an output signal is applied from AND gate 121. In a similar manner, a pulse is passed through AND gate 124 when a positive pulse is applied from missing pulse detector 120 to AND gate 124 and concurrently, therewith, a signal is passed through AND gate 122. It will be seen that the AND gate 123 will pass a signal only when both the X and Y sensing coils have low output signals. For this reason the output gate 123 is designated the $\overline{X}\,\overline{Y}$ gate. In a similar manner, AND gate 124 is designated the XY gate and it produces an output signal when both the X and Y sensing coils produce a high output signal.

The output of the $\overline{X}\,\overline{Y}$ AND gate 123 is applied to a missing pulse detector 126 and the output of the XY AND gate 124 is applied to a missing pulse detector 127. The missing pulse detectors 126 and 127 are similar to the missing pulse detectors 119 and 120 in that they produce a positive output when an input signal is present and a negative output when an input signal is absent. The outputs of the missing pulse detectors 126 and 127 are connected to the terminals of the transformer winding 128. In the normal course of events, with no train within the limits of the system as defined by the shorting bonds 103 and 104, the output potentials of the sensing coils X and Y will alternate between high and low value and in accordance with the system, as described, this will result in the output of the missing pulse detectors 126 and 127 alternating between +6 volts and −6 volts with one having a positive output while the other has a negative output. That is, while both sensing coils X and Y have low outputs, pulses will be passed through AND gates 121 and 123 to missing pulse detector 126 and the output of the missing pulse detector 126 will be at +6 volts. At the same time, no pulse will pass through AND gates 122 and 124, therefore, the output of missing pulse detector 127 will be at −6 volts. When the output potential of the X and Y sensing coils rise to their high value, the outputs of the missing pulse detectors 126 and 127 will be reversed. These reversals will take place at the frequency of the modulator 116. The result is that, in effect, an alternating current potential is applied to the transformer winding 128. Accordingly, a potential will be induced into transformer winding 129. It should be observed that the magnetic coupling between the transformer windings 128 and 129 constitutes a magnetic core that is magnetically saturated in response to a pulse of current in transformer winding 128. Accordingly, if successive pulses of current in the same direction are applied to transformer winding 128, no potential will be induced into transformer winding 129. However, each time the direction of current in the transformer winding 128 changes direction, the magnetic core will be saturated in the opposite direction and a pulse will be induced in transformer winding 129. Stated in different terms, this means that so long as the output potentials of the X and Y sensing coils alternate between high and low values a potential will be induced from transformer winding 128 and 129. But, if the output potential of either the X or Y, or both, sensing coils remains fixed, there will be no potential induced in transformer winding 129 from transformer winding 128. In order to make the square wave transformer function with an even greater margin of "fail-safe" safety factor and over wider ranges of voltage, temperature and other conditions, it might be convenient to separate the primary winding into two sections as more fully shown in FIG. 2.

The output of transformer winding 129 is coupled as an input to diode bridge 130. Relay 131 is coupled to the output of diode bridge 130. Accordingly, as long as a potential is induced into transformer winding 129 from transformer winding 128, a d.c. current is passed through relay 131 and it will maintain its contacts 133 and 134 closed. If the output of either or both the sensing coils X and Y should remain either high or low, there will be no transformer action from transformer winding 128 to 129, and the relay 131 will be released, thereby closing contacts 132 and 133.

By a means which is well known and which is not shown herein, the closed state of contacts 133 and 134 can provide an indication that the system is functioning properly and that there is no train within the limits of the block defined by the track section between shorting bonds 103 and 104. In a similar manner, the closing of contacts 132 and 133 will indicate either a malfunction of the system or the presence of a train within the track section.

TRACK CIRCUIT WITH A SWITCH

The principles involved in determining the presence of a train within the boundaries of a track section, or block, as discussed in connection with FIG. 1, are also used in the configuration shown in FIG. 2. The principle differences reside in the fact that the configuration of the FIG. 1 involved the use of two track segments within the track section, whereas the configuration of FIG. 2 requires the identification of three separate segments.

It will be seen that adjacent segments share at least one common leg and that a current is induced from an oscillator into each segment and that sensing coils are employed to sense currents in the common legs; and gate circuits are used to gate the sensed signals, together with other signals, to provide an indication when there is, and when there is not, a train occupying one or more segments of the section.

For convenience in comparing the features and operations of the circuits of FIGS. 1 and 2, components which provide substantially the same or similar functions are identified by numbers which differ only in their first digit. However, it should be noted that in FIG. 1 the modulator applied a test shunt across the tracks, while in FIG. 2 it will be seen that the modulator controls the a.c. current to one of the induction coils. In both cases the modulator causes the output of the sensing coils X and Y to alternate between high and low outputs.

Considering now more specifically FIG. 2, there will be seen a pair of mainline rails 201 and 202, which after continuing from left to right through switch entry points K and P, are designated 201-1 and 202-1. Depending upon the setting of the switch, train entering the switch from left to right on rails 201 and 202 may be diverted to the branch line 201-2 and 202-2. For convenience in identification, various junction points have been identified with a letter. The mainline tracks 201 and 202 extend between the points designated J and K and Q and P, respectively. The mainline tracks continue with the designations 201-1 and 202-2 and extend from letter K to L and from P through N to M. The branch tracks 201-2 and 202-2 extend from K through N to R and from P to S, respectively.

Shorting bonds are used at the outer ends of the track section. There is a shorting bond between points J and Q of the mainline track 201 and 202. There is another shorting bond between points L and M; and between points R and S. In addition, the rail 201-2 is electrically bonded to the rail 201 and 201-1 at the point K. There is also a bond at the junctions of rails 202, 202-1 and 202-2 at point P. And there is an electrical bond between rails 201-2 and 202-1 at point N.

A first segment, D, may be defined as that portion of the track circuit within the area defined by the connection of points J, K, N, P, Q, and back to J. A second segment, E, may be defined as that area defined by the connection of points K, L, M, N, and back to K. A third segment, F, may be defined as that area enclosed by the joining of points P, N, R, S, and back to P. The shorting bond from J to Q is designated 203 while the shorting bond from L to M is designated 204 and the bond between points R and S is designated 205. Induction coils A, B, and C are used to induce currents in the track sengments D, E, and F, respectively.

An oscillator 207 provides a signal to amplifiers 208-1 and 208-2 which in turn provide signals to the coils B, C, and A for inducing signals into their respective track segments as mentioned above. The oscillator signal 207 applied to the amplifier 208-2 passes through AND gate 235 and is gated with a signal from modulator 216 so that the signal from the oscillator 207 is applied to the amplifier 208-2 intermittently at a rate determined by the modulator 216. The resistors 209-1, 209-2 and 209-3 provide a means for adjusting the magnitude of the current induced in segments D, E, and F, respectively. If required to obtain the necessary balance and current relationship, capacitors (not shown) may be used in series with the resistors 209-1, 209-2, and/or 209-3.

Although the configuration of FIG. 1 was seen to employ a sensing coil for each segment, it will be seen that the configuration of FIG. 2, which has three segments, employs only two sensing coils. More specifically, sensing coil 210, also designated X, is located near the track 201-2 between points K and N. Sensing coil 211, also designated Y, is located near the mainline track 202-1, between points N and P. The sensing coil Y will be seen to be near a common leg between segments D and F. The sensing coil X will be seen to be near a leg that is common to segments D and E. It should be noted that segment D has one leg which is common with segment E and another leg which is common with segment F. The segments E and F each have only one leg which is common with another segment, specifically segment D.

The induction coils A, B, and C are so connected that at the time that the current in segment D is flowing in the direction J–K–N–P–Q; the current in segment E is flowing in the direction M–N–K–L–M; and the current in segment F is flowing in the direction S–P–N–R–S. From this, it will be seen that the current sensed by sensing coil X will comprise components from segments D and E and these currents are adjusted to be substantially equal and, as shown, are in opposite directions. Accordingly, while currents are flowing in segments D and E, the resultant output of sensing coil X will be substantially zero. In the same manner, the sensing coil Y responds to the resultant of the currents flowing in segments D and F and, therefore, when currents are flowing in segments D and F, the output signal of sensing coil Y will be substantially zero. However, is already indicated, the modulator 216 serves to periodically interrupt the flow of current in coil A. Accordingly, the outputs of sensing coils X and Y will vary between zero and values determined by the magnitude of the current in segments E and F, respectively. That is, the outputs of sensing coils X and Y will alternate between high and low values at the rate determined by modulator 216. This discussion assumes that there is no train within the limits of any segment.

The outputs of the sensing coils X and Y are applied to amplifiers 217 and 218, respectively. The outputs of amplifiers 217 and 218 are applied to missing pulse detectors 219 and 220, respectively. The missing pulse detectors shown in FIG. 2 may be identical to those shown in FIG. 1.

The output of the oscillator 207, together with the output of the modulator 216, is gated through AND gates 241 and 242. An output from AND gate 241 indicates that the oscillator 207 is functioning and that a signal from tthe modulator 216 and the oscillator 207 is gated through AND gate 235 to amplifier 208-2. An output from AND gate 242 indicates that the oscillator 207 is functioning and that no signal is gated through AND gate 235. Phrased differently, the output of AND gate 241 is designated A to indicate that the signal from oscillator 207 is being applied to induction coil A. In a similar manner, the output of AND gate 242 is designated $\overline{A}$ to indicate that the output of oscillator 207 is not being applied to induction coil A. The output of missing pulse detector 219 is applied to AND gates 221 and 222 in such a manner that the AND gate 221 will produce an output when there is an output from AND gate 241 and the output signal of sensing coil X is zero. In a similar manner, there will be an output from AND gate 222 when there is an output signal from AND gate 242 and there is an output potential from sensing coil X. Phrased differently, there is an output signal from AND gate 221 when oscillator current 207 is applied to induction coil A and there is no output potential from sensing coil X. Accordingly, the output of AND gate 221 is designated $A\overline{X}$. In a similar manner, the output of AND gate 222 indicates that the oscillator signal is not being applied to induction coil A and there is an output potential from sensing coil X. Accordingly, this output lead is designated $\overline{A}\overline{X}$. The outputs of AND gates 221 and 222 are applied as inputs to AND gates 223 and 224, respectively. In addition, the output of missing pulse detector 220 is applied to AND gates 223 and 224 in such a manner that there will be an output from AND gate 223 only when the oscillator signal is applied to induction coil A and both sensing coils X and Y have zero output. AND gate 224 will produce an output only when no signal from oscillator 207 is applied to induction coil A and sensing coils X and Y are producing high output signals.

Each time the modulator 216 cuts off the signal from oscillator 207 to induction coil A, the outputs of sensing coils X and Y will go high and there will be an output from AND gate 224. Each time the modulator 216 passes a signal from oscillator 207 to induction coil A, the output signals from sensing coils X and Y will go low and there will be an output from AND gate 223. In summary, AND gates 223 and 224 will alternately produce output signals at the rate determined by the modulator frequency 216. The output signals of AND gates 223 and 224 will be applied to missing pulse detectors 226 and 227.

The outputs of missing pulse detectors 226 and 227 may be connected to a circuit similar to that shown coupled to the missing pulse detectors 126 and 127 of FIG. 1. However, the arrangement shown in FIG. 2 provides additional safeguards for protection against various types of component failures or other difficulties.

The missing pulse detectors 226 and 227 provide a +6 volt output signal in response to an input signal and a −6 volt output when there is no input signal. Accordingly, with no train in the section, the outputs of the missing pulse detectors 226 and 227 will alternate between +6 volts and −6 volts with one being +6 volts while the other is −6 volts. With the saturable transformer of FIG. 1, there is a possibility that some types of circuit and/or component failures in the missing pulse detector could result in maintaining the relay 131 operated. The circuit modification of FIG. 2 provides protection.

The signals from missing pulse detectors 226 and 227 pass through current limiting resistors 236 and 237, respectively, and via the 4-terminal capacitors 238 and 239 to windings 228-1 and 228-2, respectively, of the saturable transformer. The 4-terminal capacitors have one terminal coupled to a −6 volt reference potential and filter out any high frequency component of the output signal from the missing pulse detectors 226 and 227. By this means a signal will be passed through the saturable transformer to maintain the relay 231 operated only as long as both missing pulse detectors 226 and 227 are functioning. The relay 231 will receive current from transformer coil 229 rectified by diode bridge 230. With relay contacts 233 and 234 closed, a signal is provided indicating the system is functioning properly and that there is no train in the track section. If relay 231 releases contacts 232 and 233, will close to indicate a system failure or the presence of a train.

Consideration will now be given to the effect of a train entering one of the segments. It will be assumed that a train enters the segment D. With a train in the segment D, there will be a short circuit between rails 201 and 202; and when a current is induced into the rails from induction coil A, the major portion of this current will pass through the train wheels and axle and little, if any, will go through the leg from K to N. Accordingly, the loop current in segment D will no longer have its customary effect on sensing coil X and the output of sensing coil X will remain high. That is, sensing coil X will sense the loop current in segment E and, therefore, no signal will ever be gated through gate 221. With no signal gated through gate 221, there will be no signal through AND gate 223 and no transformer action will take place and relay 231 will release. Thus, in summary, when a train enters segment D, the relay 231 will release and its contacts will provide appropriate signals.

If a train enters segment E from the right, its wheels and axles will provide a short circuit between rail 201-1 and 202-1. Accordingly, the loop segment current will pass primarily through the wheels and axle and little, if any, current will pass through the rail section 201-2 and be sensed by sensing coil X. Although the sensing coil X does not respond to the loop current in segment E, it will be seen that the output of sensing coil X alternates between high and low values as the modulator 216 controls the application of the output of oscillator 207 to the induction coil A. However, while current is being applied to induction coil A, the output of sensing coil x will be high and while no oscillator current is being applied to induction coil A, the output potential of sensing coil X will be low. Analysis of the functions of AND gates 221 and 222 will show that this combination does not admit of an output from either AND gate 221 or AND gate 222. That is, AND gate 221 can gate a signal while there is a current in induction coil A and no current in sensing coil X. However, as stated, when there is a train in segment E, there will be a current in sensing coil X concurrent with a current in inductiion coil A. AND gate 222 can pass a signal when there is no current in induction coil A and there is an output from sensing coil X. However, when there is a train in segment E, this condition does not prevail and there will be no output signal from AND gate 222. With no output signals from either AND gate 221 or AND gate 222, the relay 231 will not be maintained operated and and appropriate signal will be provided by contacts 232 and 233.

If a train enters track segment F, a minimum signal from segment loop current induced by coil C will be sensed by sensing coil Y. Accordingly, the output of sensing coil Y will alternate between high and low as the signal to induction coil A is turned on and off, respectively. As with the case when a train entered track segment E, it will be found that the high and low outputs of the sensing coil Y are such that no output signals will be obtained from AND gates 223 and 224. That is, when a signal is applied to induction coil A, there is an output potential from sensing coils X and Y and, therefore, no signal is passed through AND gate 223. In a similar manner, when no signal is applied to induction coil A, there is no output from sensing coils X and Y and, therefore, there is no output from AND gate 224. Under these conditions, no signal will be passed through the missing pulse detectors 226 and 227 to maintain relay 231 operated. Accordingly, when a train enters track segment F, the relay 231 will be released and its contacts will provide appropriate signals.

As a train passes through the switch, it is inevitable that the various axles of the various cars will provide track shunts in at least two segments for at least part of the time and one of the two segments will always be segment D. Under these conditions, at least one of the sensing coils will produce a continuous low output and, therefore, the relay 231 will not be maintained operated and appropriate signals will be provided by the contacts of relay 231 to indicate that the switch is occupied.

While there has been shown and described what is considered at present to be the preferred embodiment of the invention, modifications thereto will readily occur to those skilled in the related arts. For example, the shorting bonds may be replaced with a series tuned circuit to allow other track signals to pass through the section, and a variety of other gating techniques could be employed. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. A railroad track circuit for detecting the presence of a railroad vehicle shunt across the rails and within the limits of a track section, said track section having ends defined by shorting bonds across the rails and comprising in combination:

a. first and second segments of said track section with each segment sharing a leg in common with the other segment;

b. circuit means for coupling an a.c. signal from a signal generating means to said first and second segments of said track section;

c. first and second sensing means coupled to said first and second segments, respectively, for responding to the a.c. signal coupled to each segment of said track section;

d. modulating means coupled to said track section for intermittently effecting the signal sensed by said sensing means; and e. detecting means coupled to said sensing means for responding to the changing signal sensed by said sensing means.

2. The combination as set forth in claim 1, wherein said sensing means responds to the resultant current in said common leg.

3. The combination as set forth in claim 2, wherein said modulating means modulates the a.c. signal coupled to one of said track segments.

4. The combination as set forth in claim 3, wherein said detecting means includes gating means for selectively gating signals from said sensing means and said signal generating means.

5. The combination as set forth in claim 4, wherein said detecting means further includes a saturable transformer which is saturated in alternate directions in response to signals gated through said gating means when no railroad vehicle shunt is detected in either track segment and said modulating means is functioning.

6. The combination as set forth in claim 5 and including means coupled to said saturable transformer and responsive to its periodic saturation in alternate directions for providing a first signal and a second signal when said saturable transformer is and is not saturated in alternate directions at said periodic rate, respectively.

7. The combination as set forth in claim 1, wherein said sensing means comprises first and second sensing means with each sensing means coupled to an individual segment of said track section.

8. The combination as set forth in claim 7, wherein said modulating means periodically shunts one winding of a transformer the other winding of which is in series with said common leg of said segments.

9. The combination as set forth in claim 8, wherein said detecting means includes gating means for selectively gating signals from said first and second sensing means and said signal generating means.

10. The combination as set forth in claim 9, wherein said detecting means further includes a saturable transformer which is saturated in alternate directions in response to signals gated through said gating means when no railroad vehicle shunt is detected in either track segment and said modulating means is functioning.

11. The combination as set forth in claim 10 and including means coupled to said saturable transformer and responsive to its periodic saturation in alternate directions for providing a first signal and a second signal when said saturable transformer is and is not saturated in alternate directions at said periodic rate, respectively.

12. The combination as set forth in claim 1 and including;

a. a third segment of said track section coupled to said first and second segments so that said track section comprises a Y switch and said first segment has one leg in common with said second segment and another leg in common with said third segment; and b. said circuit means includes means for coupling an a.c. signal from said signal generating means to said third segment of said track section.

13. The combination as set forth in claim 12, wherein said modulating means modulates the a.c. signal coupled to said first segment.

14. The combination as set forth in claim 13, wherein said sensing means comprises a first sensor coupled to the common leg between said first and second segments, and a second sensor coupled to the common leg between said first and third segments.

15. The combination as set forth in claim 14, wherein the signals coupled into said first and second segments produce opposing signals in said common leg between said first and second segments; and the signals coupled into said first and third segments produce opposing signals in said common leg between said second and third segments.

16. The combination as set forth in claim 15 and including adjusting means for adjusting the a.c. signals so that the resultant signals in said common legs approach zero when there is no railroad vehicle shunt within any segment.

17. The combination as set forth in claim 16, wherein said detecting means includes gating means for selectively gating signals from said first and second sensors and said signal generating means.

18. The combination as set forth in claim 17, wherein said detecting means further includes a saturable transformer which is saturated in alternate directions in response to signals gated through said gating means when no railroad vehicle shunt is detected in any track segment and said modulating means is functioning.

19. The combination as set forth in claim 18 and including means coupled to said saturable transformer and responsive to its periodic saturation in alternate directions for providing a first signal and a second signal when said saturable transformer is and is not saturated in alternate directions at said periodic rate, respectively.

20. A railroad track circuit for detecting the presence of a railroad vehicle shunt across the rails and within the limits of a track section, said track section having ends defined by shorting bonds across the rails and comprising in combination;

a. circuit means for coupling an a.c. signal from a signal generating means to each end of said track section such that the currents coupled to said track section are in opposition;

b. rail current sensors at each end of said track section for detecting and responding to the resultant of the currents in said track section;

c. shunt means intermittently shunting said track section at an intermediate point for intermittently increasing the currents in said rail current sensors; and d. detecting means for responding to the change of current in said rail current sensors responsive to the intermittent shunting of said track section by said shunt means.

21. The combination as set forth in claim 20, wherein a transformer is used to intermittently shunt said track section.

22. The combination as set forth in claim 21, wherein said transformer has one winding bridging said track section and a second winding connected as an output of a diode bridge whose input is intermittently shunted.

23. The combination as set forth in claim 22 and including a transistor and modulator with the emitter-collector circuit of said transistor coupled as an input to the diode bridge and the transistor intermittently rendered conducting by said modulator which is coupled to the base of said transistor

24. The combination as set forth in claim 20, wherein said detecting means produces a continuous output signal in response to the intermittent change of current in both of said rail current sensors.

25. The combination as set forth in claim 24, wherein said detecting means comprises;

a. a first and second gates for passing a signal indicative of when the current in said rail current sensors is normal and is increased by said shunt means, respectively.

26. The combination as set forth in claim 25 and including a saturable transformer which is saturated in first and second directions in response to signals gated through said first and second gates, respectively.

27. The combination as set forth in claim 26, wherein the output of said saturable transformer provides a first signal when signals are gated through said first and second gates and a second signal when signals are not gated through said first and second gates.

* * * * *